US005994607A

United States Patent [19]

Joly et al.

[11] Patent Number: 5,994,607

[45] **Date of Patent: *Nov. 30, 1999**

[54] PARAFFIN ISOMERIZATION PROCESS COMPRISING FRACTIONATION HAVING AT LEAST TWO DRAW-OFF LEVELS ASSOCIATED WITH AT LEAST TWO ISOMERIZATION ZONES

[75] Inventors: Jean-Francois Joly, Lyons; Pierre Boucot, Ternay; Michel Thery, Vernaison; Olivler Clause, Chatou; Jean-Charles Viltard, Les Belles Feuilles, all of France

[73] Assignee: Institut Francais du Petrole, Rueil-Malmaison, France

[ * ] Notice: This patent is subject to a terminal disclaimer.

[21] Appl. No.: 09/129,127

[22] Filed: Aug. 4, 1998

Related U.S. Application Data

[63] Continuation-in-part of application No. 08/795,703, Feb. 4, 1997, Pat. No. 5,831,140.

[30] Foreign Application Priority Data

Feb. 5, 1996 [FR] France ..... 96/01.470

[51] Int. Cl.[6] ..... C07C 5/13; C07C 1/00

[52] U.S. Cl. ..... 585/736; 585/734; 585/738; 585/739; 585/750; 585/751; 585/300

[58] Field of Search ..... 585/734, 736, 585/738, 739, 750, 751, 300

[56] References Cited

U.S. PATENT DOCUMENTS

| | | | |
|---|---|---|---|
| 4,503,265 | 3/1985 | Schleppinghoff et al. | 568/697 |
| 5,177,283 | 1/1993 | Ward | 585/446 |
| 5,831,140 | 11/1998 | Joly et al. | 585/736 |

*Primary Examiner*—Glenn Caldarola
*Assistant Examiner*—In Suk Bullock
*Attorney, Agent, or Firm*—Millen, White, Zelane, & Branigan, P.C.

[57] ABSTRACT

The invention concerns a process for isomerising a feed containing essentially hydrocarbons, preferably paraffins containing principally 4 to 8, preferably princiapply to 6 and more principally 5 and/or 6 carbon atoms per molecule, comprising a fractionation zone and at least two isomersation reaction zones, said process comprising carrying out the following steps:

(1) sending the feed to a fractionation zone;

(2) drawing off at least a portion of the liquid circulating in said zone, via at least two draw-off levels; and (3) sending the major portion of the liquid drawn off in step (2) to at least two isomerisation zones, each isomerisation zone being associated with a draw-off level.

11 Claims, 1 Drawing Sheet

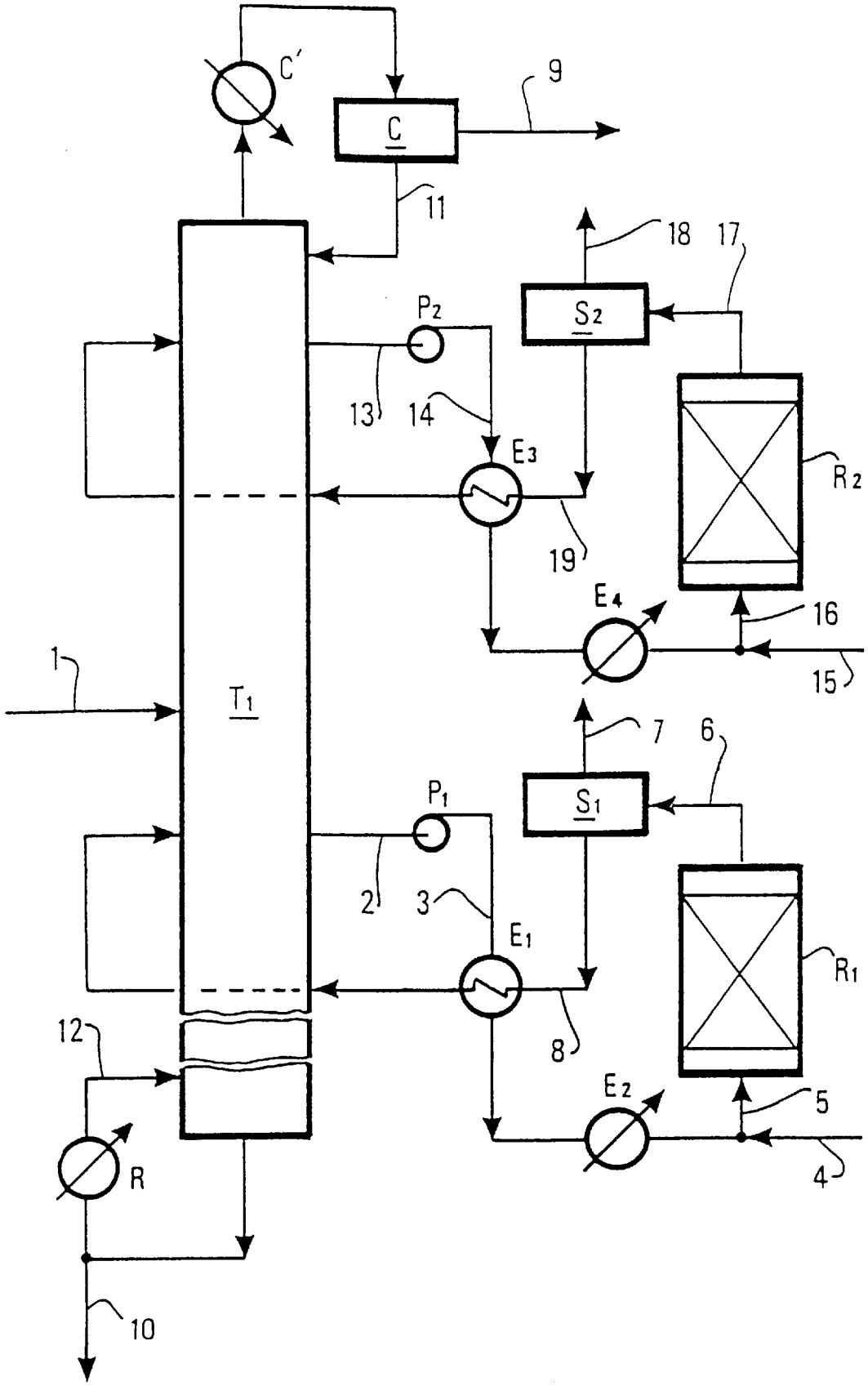
C'
C
9
11
18
17
S2
P2
13
14
E3
R2
19
E4
16
15
1
T1
7
6
S1
P1
2
3
E1
R1
8
12
E2
5
4
R
10

PARAFFIN ISOMERIZATION PROCESS COMPRISING FRACTIONATION HAVING AT LEAST TWO DRAW-OFF LEVELS ASSOCIATED WITH AT LEAST TWO ISOMERIZATION ZONES

CROSS-REFERENCE TO RELATED APPLICATION

This application is a continuation-in-part of allowed application Ser. No. 08/795,703 filed Feb. 4, 1997, now U.S. Pat. No. 5,831,140, incorporated by reference in its entirety.

FIELD OF THE INVENTION

The present invention concerns a novel process for isomerising hydrocarbons, preferably paraffins, and more preferably the major portion being paraffins containing principally 4 to 8, preferably principally 4 to 6, and more preferably principally 5 and/or 6 carbon atoms per molecule, in which at least one fractionation column is used associated with at least two external reaction zones containing at least one solid acid catalyst.

BACKGROUND OF THE INVENTION

Elimination of lead alkyls from automobile gasolines, in particular for the purposes of environmental protection, has meant that processes for the production of branched paraffins, in particular the isomerisation of normal paraffins to branched paraffins, is now gaining importance in the petroleum industry. Isomerisation of n-butane can produce isobutane which, after dehydrogenation, can be used in processes for alkylating light olefins with at least one isoparaffin to produce paraffinic cuts containing 5 to 12 carbon atoms per molecule. These cuts have high octane numbers. After dehydrogenation, isobutane can be used in etherification using methanol or ethanol. The ethers obtained (MTBE, ETBE), have high octane numbers and can be incorporated into gasoline fractions.

The process for the isomerisation of hydrocarbons, preferably paraffins, containing principally 4 to 8, preferably principally 4 to 6, and more preferably principally 5 and/or 6 carbon atoms per molecule, is also a process which produces gasoline stock with high octane numbers which can be directly incorporated into gasoline fractions (pool gasoline).

This latter process has been the subject of numerous studies. Three different types of catalyst have traditionally been used to carry out the isomerisation reaction:

- Friedel-Crafts type catalysts such as aluminium chloride, used at low temperatures (about 20° C. to 130° C.);
- catalysts based on a metal from group VIII deposited on alumina, generally a halogenated alumina, preferably a chlorinated alumina, used at medium temperatures (about 150° C.), for example those described in U.S. Pat. Nos. 2,906,798, 2,993,398, 3,791,960, 4,113,789, 4,149,993, 4,804,803, European patent applications EP-A-0 514 527, EP-A-0 661 095, EP-A-0 661 370 and EP-A-0.750.941.
- zeolitic catalysts comprising at least one group VIII metal deposited on a zeolite, used at high temperatures (250° C. and more), for example those described in U.S. Pat. Nos. 4,727,217, 4,789,655, 4,935,578, 4,943,546 and 4,977,121 where the zeolite is a mordenite, and those described in U.S. Pat. Nos. 4,724,007, 4,780,736, 4,891,200, 5,157,198, 5,165,906, 5,277,791 and European patent application EP-A-0 601 924 where the zeolite is omega zeolite. These catalysts lead to slightly smaller octane number gains but have the advantage of being easier to use and more resistant to poisons; nevertheless, their lower acidity means that they cannot be used for the isomerisation of n-butane.

Current processes for the isomerisation of hydrocarbons, preferably $C_4$–$C_8$ paraffins, use catalysts based on platinum deposited on high activity chlorinated alumina which operate without recycling or with partial recycling, after fractionation of the unconverted n-paraffins, or with total recycling after passage over molecular sieve beds.

Operation without recycling, while simple, lacks efficiency in increasing the octane number. In order to obtain high octane numbers, the low octane number constituents must be recycled after passage either through separating columns (for example a deisohexaniser) or over molecular sieves, in the liquid or vapour phase.

The use of molecular sieves has its disadvantages, among them difficulties with using isomerisation catalysts based on a halogenated alumina when it is a chlorinated alumina, because of the risks of contamination of the integral molecular sieves with hydrochloric acid, which difficulties are sometimes overcome by using a chlorine trapping apparatus between the isomerisation zone and the adsorption zone when possible. Techniques using molecular sieves have been developed which operate in the presence of the isomerisation reactor containing catalysts based on chlorinated alumina impregnated with platinum. As an example, a non integrated system can be envisaged which employs a step for stabilising the isomerisation effluent before sending it to the molecular sieve adsorption step. However, such techniques are complex and one of its disadvantages is that it is a batch process. For this reason, catalytic systems which are of lower performance have been used, based on zeolite and not using chlorine. This results in a product with an octane number which is lower by 1 to 2 points to that which would have been obtained with a catalyst based on chlorinated alumina. The laws of thermodynamics dictate that the lower the temperature, the higher the conversion of n-paraffins to isoparaffins and further, the better the conversion of $C_6$ isomers with low octane number (methylpentanes) to $C_6$ isomers with a higher octane number (dimethylbutanes).

In addition, "conventional" layouts must be considered which use separation columns (deisopentaniser and deisohexaniser), since separation columns can be protected from chlorine contamination. However, these layouts require a lot of equipment and consume large quantities of energy, and are thus expensive to use. A layout using a single separation column (the deisohexaniser alone) would be less expensive but could not convert all of the normal-pentane to isopentane and thus could not obtain the octane number increase obtained with recycling schemes.

Finally, U.S. Pat. No. 5,177,283, which describes the production of alkylbenzenes, mentions the possibility of associating a fractionation column which carries out distillation with a single external reaction zone for the isomerisation of $C_4$–$C_8$ paraffins, the effluent from the reaction zone being returned to the column just below the point where the feed is removed from the reaction zone.

SUMMARY OF THE INVENTION

The present invention concerns a process which can increase the octane number of a petroleum cut containing normal paraffins by as much as possible, and which in particular can overcome the disadvantages mentioned above. The process of the invention is characterized in that it does not comprise the techniques of separation by adsorption on molecular sieves and in that it uses only one fractionation column (deisopentaniser or deisohexaniser). Further, the efficiency of the process of the invention is linked, among others, to the presence of at least two independent reaction zones associated with the fractionation zone.

One of the unexpected advantages of the process of the present invention is that it is possible to use either catalysts based on chlorinated alumina or zeolite based catalysts (such as mordenite or omega zeolite). The process of the present invention can, surprisingly, result in isoparaffin yields, in particular of isopentane, which are close whichever of the two types of catalyst is used. This is a very important advantage, since the use of zeolite based catalysts in prior art processes has led to isopentane yields which are far inferior to those obtained in the presence of chlorinated alumina.

The invention concerns a process for isomerising a feed containing essentially hydrocarbons, preferably paraffins, and more preferably the major portion being paraffins, containing principally 4 to 8 carbon atoms per molecule, preferably principally 4 to 6 carbon atoms per molecule and more preferably principally 5 and/or 6 carbon atoms per molecule (i.e., selected from the group formed by paraffins containing principally 5 carbon atoms per molecule and paraffins containing principally 6 carbon atoms per molecule), in which said feed is treated in a fractionation zone which comprises an exhausting zone and a rectification zone, and at least two isoinerisation zones, said process comprising carrying out the following steps:

(1) sending the feed to a fractionation zone at an injection level;

(2) drawing off at least a portion, preferably the major portion, of the liquid flowing in said zone, preferably flowing in the rectification zone, and more preferably flowing at an intermediate level of the rectification zone, via at least two, preferably 2 to 6 and more preferably 2 to 4 draw-off levels; and (3) sending the major portion of each of the liquid portions drawn offin step (2) to at least two isomerisation zones, each isomerisation zone being assocaited with a draw-off level, to obtain effluents; and optionally (4) sending the major portion of each of the effluents from step (3) to the fractionation zone, substantially adjacent to a draw-off level, preferably to the corresponding draw-off level, i.e., associated with the isomerisation zone from which the effluent is extracted, or substantially adjacent to the feed injection level; and (5) recovering an effluent from the fractionation zone.

Step (4) is generally such that all the effluent from step (3) is generally directed substantially adjacent to (i.e., beneath, or above, or at the same height) a single draw-off level corresponding to it, and towards which the other effluent(s) from step (3) are not directed.

In the case where, for a given effluent from step (3), the corresponding draw-off level is close to the feed injection level, it is possible to mix said effluent with the feed to send said mixture to the fractionation zone of step (1) at the injection level height.

In one preferred implementation of the process of the invention, each effluent from step (3) is directed substantially adjacent to a single draw-off level, to which it corresponds and each of the effluents from step (3) is returned substantially adjacent to its corresponding draw-off level or substantially adjacent to the feed injection level.

In a further preferred implementation of the process of the invention, which may or may not be independent of the preceding implementations, each isomerisation reaction zone receives the effluent from a single draw-off level corresponding to it, the effluent from said reaction zone being returned substantially adjacent to the corresponding draw-off level or substantially adjacent to the feed injection level.

The feed supplying the process of the invention is from any source known to the skilled person, for example a light naphtha cut from a naphtha fractionation unit or a light reformate, preferably substantially free of benzene, and more preferably substantially free of benzene, any other unsaturated compound containing at most six carbon atoms per molecule, and optionally any other compound such as cyclohexane or any isoparaffin containing seven carbon atoms per molecule.

The feed supplied to the fractionation zone is generally introduced into the zone to at least one level of said zone, preferably principally to a single level in said zone.

The fractionation zone which carries out fractionation by continuous distillation, as is known to the skilled person, generally comprises at least one column provided with at least one distillation device selected from the group formed by plates, loose packing and structured packing, as is known to the skilled person, such that the global overall theoretical efficiency is at least five theoretical plates. In cases which are known to the skilled person where the use of a single column causes problems, it is generally preferable to divide the zone and use at least two columns which, placed end to end, form said zone, i.e., the rectification zone and the exhausting zone are distributed over the columns.

The fractionation zone generally separates the feed into a distillate which is rich in isopentane containing, for example, 2 to 20 mole % of n-pentane, and a residue which is depleted in isopentane containing, for example, 2 to 15 mole % of isopentane. Before being introduced into the zone, the feed can be preheated, for example to a temperature of 30° C. to 60° C. The fractionation zone generally operates between a bottom temperature which is in the range 40° C. to 90° C. and a top temperature which is in the range 20° C. to 60° C.

Further, and in preferred fashion, the reaction zones are independent, i.e., each reaction zone can operate under its own operating conditions (catalyst, temperature, pressure . . . ).

The liquid effluent which is extracted from the column as a side stream at the draw-off level is sent to a reaction zone comprising at least one reactor, preferably a single reactor, which is independent of the separation column and in which isomerisation of normal-paraffins to isoparaffins is effected. When the reaction zone comprises at least two reactors, these can be disposed in series or in parallel. The number of independent reaction zones is equal to the number of liquid side streams drawn off from the separation column. The effluent extracted from the reaction zone is recycled to the fractionation zone, preferably substantially adjacent to the draw-off zone corresponding to said reaction zone.

In one implementation of the process of the invention, the catalyst in at least one reaction zone is based on a group VIII metal deposited on alumina, and preferably said alumina is halogenated and more preferably said alumina is chlorinated. In a first example, said alumina is constituted by eta alumina and/or gamma alumina, the alumina content is generally between 85% and 95% by weight. In a second example, said alumina is gamma alumina. The alumina based catalysts may be those described in the patents or patent applications cited above.

Finally, in a further implementation of the process of the invention, which may or may not be independent of the preceding implementations, the catalyst in at least one reaction zone is based on a group VIII metal on zeolite, and preferably said zeolite is of structure type mordenite, preferably a mordenite or a zeolite with structure type mazzite, preferably an omega zeolite. Said zeolite based catalysts may be those described in the patents or patent applications cited above.

Regardless of the type of catalyst used (either alumina based or zeolite based), the group VIII metal is preferably selected from the group formed by platinum, nickel and palladium. For platinum or palladium, the content is in the range 0.05% to 1% by weight, preferably in the range 0.1% to 0.6%. In the case of nickel, the content is in the range 0.1% to 10% by weight, preferably in the range 0.2% to 5%.

The isomerisation catalyst can be reduced in hydrogen before use. When the support is alumina based, the catalyst is halogenated, preferably chlorinated, using any halogenated compound which is known to the skilled person, preferably a chlorinated compound such as carbon tetrachloride or perchloroethylene. The halogenation treatment, preferably chlorination treatment, can be carried out either directly in the unit (in situ) before injection of the feed, or it can be carried out offsite. In such a case, it is also possible to carry out halogenation, preferably chlorination, prior to reducing the catalyst in hydrogen.

One of the most important advantages of the process of the invention is that the temperature and pressure conditions in the separation column and in the reaction zones can be optimised independently of each other. The reaction zones are independent, i.e., they can operate under temperature and pressure conditions which are different from each other and they can contain identical or different catalysts. As an example, the temperature in each reaction zone is advantageously higher than that in the column. When the catalyst is a zeolite based catalyst, this temperature can be greater than or equal to 200° C. Similarly, the pressure in each reaction zone is advantageously higher than the pressure in the column, for example more than 20 bar. Further, a gas stream containing hydrogen is generally distributed at the inlet to each catalytic bed in the reaction zone. The fraction of hydrogen which is not consumed at the outlet to the reaction zone, i.e., the excess hydrogen, is preferably separated from the effluent by means of a suitable receptacle, (for example a separator drum) before recycling it, preferably to the fractionation zone. However, the excess hydrogen can also be recovered then optionally compressed and used again elsewhere than in the fractionation zone. The hydrogen contained in the gas stream which feeds into each catalytic bed of the reaction zone in the process of the invention can originate from any source which produces hydrogen with at least 50%, preferably 80% and more preferably 90% purity by volume . As an example, hydrogen from catalytic reforming, methanation, PSA (pressure swing adsorption), electrochemical generation or steam cracking can be used.

Each reaction zone comprises, in part, at least one catalytic bed comprising the catalyst, preferably 1 to 4 catalytic bed(s). In each catalytic bed in the reaction zone, the gas stream, a portion of which and preferably the major portion of which contains hydrogen, generally flows in a co-current with the flow of the liquid to be isomerised.

When the operating conditions in the fractionation zone and the reaction zone(s) are correctly selected, the process of the present invention can convert more than 80%, and even more than 90%, of the n-pentane in the feed, to isopentane.

Some catalysts which can be used in the isomerisation zone(s) are:

a high activity catalyst such as a catalyst based on a halogenated alumina, preferably a chlorinated alumina. Such catalysts are constituted by a support of eta and/or gamma alumina of high purity comprising 2% to 15%, preferably 2% to 12%, more preferably 5% to 12% by weight of halogen, preferably chlorine, 0.1% to 0.35% by weight of platinum, and optionally other metals. The alumina can, for example, be a mixture of eta alumina (85% to 95% by weight with respect to the support) and gamma alumina (the remainder to 100%) or the alumina can be constituted by 100% gamma alumina.

a zeolite based catalyst, preferably a zeolite with structure type mordenite, preferably a mordenite or a zeolite with structure type omega, preferably an omega zeolite, comprising at least one metal from group VIII of the periodic classification of the elements. As an example, a known catalyst consists of a mordenite with a $SiO_2/Al_2O_3$ ratio in the range 10 to 40, preferably in the range 15 to 25, and comprising 0.2% to 0.4% by weight of platinum.

When a chlorinated alumina based catalyst is used in at least one isomerisation zone of the process of the invention, the operating conditions of that zone are as follows. The hourly space velocity is generally in the range 0.5 to 10 $h^{-1}$, preferably 1 to 4 $h^{-1}$. The reaction temperature is generally in the range 50° C. to 250° C., preferably in the range 100° C. to 180° C. The pressure is generally in the range 5 to 60 bar, preferably in the range 20 to 40 bar. The flow rate of the hydrogen injected at the reactor inlet is generally selected so that the hydrogen/hydrocarbons molar ratio at the reactor outlet is in the range 0.01 to 1, preferably in the range 0.05 to 0.15. Maintaining the degree of chlorination of the catalyst generally necessitates continuous addition of a chlorinated compound such as tetrachloroethylene or carbon tetrachloride or any other compound which is known to the skilled person, injected as a mixture with the feed at a concentration of 50 to 1000 parts per million by weight.

When a zeolite based catalyst is used in at least one isomerisation zone of the process of the invention, the operating conditions in said zone are as follows. The hourly space velocity is generally in the range 0.5 to 10 $h^{-1}$, preferably 1 to 5 $h^{-1}$. The reaction temperature is generally in the range 200° C. to 300° C., preferably in the range 230° C. to 280° C. The partial pressure of hydrogen is in the range 1 to 70 bar, preferably in the range 5 to 50 bar. The flow rate of the hydrogen injected at the reactor inlet is generally selected so that the hydrogen/hydrocarbons molar ratio at the reactor outlet is in the range 0.5 to 10, preferably in the range 1 to 5.

The final effluent obtained using the process of the invention can be used as a fuel, after optional stabilisation, either directly or by incorporation into fuel fractions.

BRIEF DESCRIPTION OF THE DRAWINGS

The accompanying FIGURE illustrates comparative Examples 1 and 3. The process shown in the FIGURE includes two draw-off levels.

The feed to be treated containing a mixture comprising normal-paraffins and isoparaffins containing 5 and/or 6 carbon atoms per molecule is introduced into a deisopentaniser T1 via line (1). A liquid phase is drawn off from one of the plates in deisopentaniser T1 via line (2) (respectively (13)). A pump P1 (respectively P2) increases the pressure of the effluent in line (2) (respectively (13)), the effluent leaving the pump via line (3) (respectively (14)) passes through a first heat exchanger E1 (respectively E3) then through a second heat exchanger E2 (respectively E4) so that the temperature of the effluent in line (3) (respectively (14)) is equal to the temperature of the n-pentane to isopentane isomerisation reaction. Pump P1 (respectively P2) brings the pressure of the effluent from line (3) (respectively (14) to a pressure which is slightly higher than the required pressure in reactor R1 (respectively R2). Heat exchanger E1 (respectively E3) can increase the temperature of effluent (3) (respectively (14)) and reduce the temperature of effluent (8) (respectively (19)) which returns to deisopentaniser T1. The liquid effluent from line (3) (respectively (14)) leaving heat exchanger E2 (respectively E4) is mixed with hydrogen (recycled and added) from line (4) (respectively (15)). The mixture is introduced to the inlet of reactor R1 (respectively R2) via line (5) (respectively (16)). It can be introduced to the bottom or the top of reactor R1 (respectively R2). The effluent leaving the reactor via line (6) (respectively (17)) is introduced into a gas-liquid separation drum $S_1$ (respectively $S_2$) from which a gaseous effluent which is rich in hydrogen is extracted for recycling to the inlet to one of reactors R1 or R2 is extracted via line (7) (respectively (18)), and an effluent which is rich in isopentane is extracted via line (8) (respectively (19)) and recycled to deisopentaniser T1, after passage through heat exchanger E1 (respectively E3). The effluent from line (8) (respectively (19)) is introduced into deisopentaniser T1 close to the plate from which the effluent is extracted via line (2) (respectively (13)), i.e., to said plate in the figure.

The flow rate of the effluents in lines (2) (respectively (13)) and (8) (respectively (19)) are equal and are in the range 0.01% to 75% of the internal flow rate of liquid in deisopentaniser T1.

A liquid effluent which is rich in isopentane is extracted overhead from deisopentaniser T1 via line (9) leaving drum C, after passage through condenser C', and an effluent containing essentially compounds in the feed other than n-pentane and isopentane is extracted from the bottom of deisopentaniser T1 via line (10). A portion of the isopentane-rich effluent is returned from drum C via line 11 as a reflux and a reboil vapour is returned via line 12 after passage through a reboiler R.

The following examples illustrate the invention without limiting its scope. Calculations were carried out using PROII version 3.3 software from Simulation Sciences Inc. Liquid-vapour equilibria were represented by the Peng-Robinson equation of state. The solubility of hydrogen in hydrocarbons was calculated using a Henry coefficient.

EXAMPLE 1

Comparative, in accordance with U.S. Pat. No. 5,177,283

The feed was constituted by a light naphtha with the following composition by weight:

isopentane 24.6 normal-pentane 27.8

2,2-dimethylbutane 1.8

2,3-dimethylbutane 3.1

2-methylpentane 15

3-methylpentane 7.1 normal-hexane 13.2 methylcyclopentane 4.3 cyclohexane 1.8

$C_7^+$1.3

This feed supplied a deisopentaniser at a flow rate of 93.6 kg/h. The column had 40 theoretical plates and operated at an overhead pressure of 2 bar with a reflux ratio of 23 with respect to the distillate. The feed was introduced to the column at the $20^{th}$ plate (plate no. 1 was the condenser C', plate no. 40 was reboiler R). 20 kg/h of a liquid distillate which was rich in isopentane (97.95 mole %) and contained about 2 mole % of normal-pentane was extracted overhead and 73.6 kg/h of a liquid effluent comprising 5 mole % of isopentane and 38.6 mole % of normal-pentane was extracted from the bottom, the remainder being constituted by compounds in the feed containing 6 carbon atom per molecule.

The column bottom was taken up by a pump and after passage through a heat exchanger, it was sent to an isomerisation reactor containing a chlorinated alumina as the catalyst. The catalyst contained 0.3% of platinum, 8% of chlorine on an alumina which was constituted by 90% of eta alumina and 10% of gamma alumina. The pressure in the reactor was 30 bar, the temperature was 150° C. Hydrogen was introduced to the inlet to the reactor in a hydrogen/hydrocarbons molar ratio of 0.3. Tetrachloroethylene was also injected to the reactor inlet at a flow rate such that the chlorine content in the effluent entering the reactor was 500 ppm by weight.

After separation of the hydrogen and HCl, the effluent leaving the reactor, i.e., 73.6 kg/h, contained 36 mole % of isopentane and 7.45 mole % of normal-pentane. The global conversion of normal-pentane with respect to the feed introduced into the deisopentaniser was thus 79.5%.

EXAMPLE 2

In accordance with the Invention

The feed used was the same as that in Example 1. The separation column was the same as that used in Example 1, the feed being introduced into the column at plate 20, and liquid was drawn off from plates 15, 30, 35 and 39 by means of pumps. The flow rates of the liquids drawn off from the plates were about 26% of the internal flow rate in the column. Four reactors containing a chlorinated alumina (identical to that used in Example 1) and operating under the same conditions as those of Example 1 were supplied via the pumps as described for two draw-off levels in the Figure.

45.7 kg/h of a liquid distillate containing 97.75 mole % of isopentane and 2 mole % of normal-pentane was extracted overhead from the column. 47.9 kg/h of a liquid effluent containing 5 mole % of isopentane and 3.2 mole % of normal-pentane was extracted from the bottom of the separation column. The column thus had a reflux ratio of 11.6.

The global conversion of normal-pentane was thus 91.4%.

The use of the process of the present invention thus produced a substantially superior degree of conversion for normal-pentane, 91.5% as compared with 79.5%, at 150° C., compared with the use of the conventional layout of Example 1, in accordance with U.S. Pat. No. 5,177,283.

EXAMPLE 3

Comparative, in accordance with U.S. Pat. No. 5,177,283

The feed was the same as that of Example 1. This feed supplied a deisopentaniser at a rate of 93.6 kg/h. The column contained 40 theoretical plates and operated at an overhead pressure of 2 bar with a reflux ratio of 23 with respect to the distillate. The feed was introduced into the column at the $20^{th}$ plate (plate no. 1 was the condenser C' and plate no. 40 was reboiler R). 20 kg/h of a liquid distillate which was rich in isopentane (97.95 mole %) and contained about 2 mole % of normal-pentane was extracted overhead and 73.6 kg/h of a liquid effluent comprising 5 mole % of isopentane and 38.6 mole % of normal-pentane was extracted from the bottom, the remainder being constituted by compounds in the feed containing 6 carbon atom per molecule.

The column bottom was taken up by a pump and after passage through a heat exchanger, it was sent to an isomerisation reactor containing a catalyst based on dealuminated mordenite (Si/Al=15; Pt content=0.35% by weight). The reaction temperature was 254° C., the total pressure was 30 bar, the hourly space velocity was 1.5 $h^{-1}$ and the hydrogen/hydrocarbons molar ratio was 4.

After separation of the hydrogen, the effluent leaving the reactor, i.e., 73.6 kg/h, contained 32.7 mole % of isopentane and 10.89 mole % of normal pentane. The global conversion of normal-pentane with respect to the feed introduced into the deisopentaniser was thus 70.7%.

EXAMPLE 4

In accordance with the Invention

Example 2 was repeated, replacing the catalyst based on chlorinated alumina with the mordenite based catalyst of Example 3:

44.6 kg/h of a liquid distillate containing 98.01 mole % of isopentane and 2 mole % of normal-pentane was extracted overhead from the separation column. 48.98 kg/h of a liquid effluent containing 5 mole % of isopentane and and 5.58 mole % of normal-pentane was extracted from the bottom of the separation column. The column thus had a reflux ratio of 16.

The global conversion of normal-pentane was thus 87.57%.

The use of the process of the present invention thus produced a substantially superior degree of conversion for normal-pentane, 87.57% as compared with 70.7%, compared with the use of the conventional layout of Example 3, in accordance with U.S. Pat. No. 5,177,283.

Further, the performances obtained with the reactors operated at 254° C. were, surprisingly, better than those of the reference case using a reactor operated at 150° C., a temperature which is more thermodynamically favourable to producing a high normal-pentane conversion. The possible use of high reactor temperatures means that the process of the invention can be carried out with low catalyst volumes.

The process of the claimed invention directed to steps (1), (2) and (3) constitute a useful subcombination including the treatment of fractionated liquid from at least two draw-off levels and the use of two isomerisation zones for conducting the isomerisation without recycling the effluent from step (3) to the fractionation zone.

The preceding examples can be repeated with similar success by substituting the generically or specifically described reactants and/or operating conditions of this invention for those used in the preceding examples.

The entire disclosure of all applications, patents and publications, cited above and below, and of corresponding French application 96/01470, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

We claim:

1. A process for catalytically isomerising a feed containing essentially hydrocarbons containing principally 4 to 8 carbon atoms per molecule, in which said feed is treated in a fractionation zone which comprises an exhausting zone and a rectification zone, and at least two isomerisation reaction zones, said process comprising carrying out the following steps:

(1) sending the feed to a fractionation zone at an injection level;

(2) drawing off at least a portion of the liquid circulating in said zone via at least two draw-off levels; and (3) sending the major portion of the liquid drawn off in step (2) to at least two isomerisation zones, each isomerisation zone being associated with a draw-off level, to obtain effluents.

2. A process according to claim 1, in which the isomerisation reaction zones are independent.

3. A process according to claim 1, in which the catalyst in at least one isomerisation zone is based on a group VIII metal deposited on alumina.

4. A process according to claim 3, in which said alumina is halogenated.

5. A process according to claim 3, in which said alumina is chlorinated.

6. A process according to claim 1, in which the catalyst of at least one reaction zone is based on a group VIII metal on zeolite.

7. A process according to claim 6, in which said zeolite is a zeolite with structure type mordenite.

8. A process according to claim 6, in which said zeolite is a zeolite with structure type mazzite.

9. A process according to claim 3, in which the Group VIII metal is nickel, palladium or platinum.

10. A process according to claim 1, comprising 2 to 6 draw-off levels.

11. A process according to claim 1, in which the feed essentially comprises paraffins.

* * * * *